US007465117B2

(12) United States Patent
Al-Khazraji

(10) Patent No.: US 7,465,117 B2
(45) Date of Patent: Dec. 16, 2008

(54) BALL OF A PEN TIP

(76) Inventor: Ziad Al-Khazraji, Renoirova 622/5, 152 00 Praha 5 (CZ)

( * ) Notice: Subject to any disclaimer, the term of this patent is extended or adjusted under 35 U.S.C. 154(b) by 89 days.

(21) Appl. No.: 11/575,593

(22) PCT Filed: May 25, 2005

(86) PCT No.: PCT/CZ2005/000039

§ 371 (c)(1),
(2), (4) Date: Mar. 20, 2007

(87) PCT Pub. No.: WO2006/032217

PCT Pub. Date: Mar. 30, 2006

(65) Prior Publication Data

US 2008/0080924 A1 Apr. 3, 2008

(30) Foreign Application Priority Data

Sep. 22, 2004 (CZ) ..... PUV 2004-15851

(51) Int. Cl.
*B43K 7/10* (2006.01)

(52) U.S. Cl. ..... 401/215; 401/216

(58) Field of Classification Search ..... 401/215, 401/216, 208, 209, 211
See application file for complete search history.

(56) References Cited

U.S. PATENT DOCUMENTS 2,992,904 A * 7/1961 Morel et al. ..... 216/42
3,166,050 A * 1/1965 Harvey et al. ..... 401/215
6,332,728 B1 * 12/2001 Ito et al. ..... 401/215
6,375,707 B1 * 4/2002 O'Donnell et al. ..... 75/241

* cited by examiner

*Primary Examiner*—David J Walczak
(74) *Attorney, Agent, or Firm*—Notaro & Michalos P.C.

(57) ABSTRACT

A ball is from D $700\times10^{-6}$ m to $2500\times10^{-6}$ m in diameter and has at least one sign engraved in the surface. The sign is constituted by a system of engraved individual cells situated on the surface of a spherical cap of the ball with a base having a circumference OD in the range from $10\times10^{-6}$ m to 0.5 n D and the diameter Dc of the circle circumscribing the plan view shape of the cell is in the range from $10\times10^{-6}$ m to ⅐ D, whereby the depth of the cell is in the range from $5\times10^{-6}$ m to 2×Dc.

16 Claims, 10 Drawing Sheets

BALL OF A PEN TIP

TECHNICAL FIELD

The invention concerns a pen ball inserted in a pen tip used mainly for the protection of signature against its falsification by means of a chosen sign in the form of an alphanumeric code and/or a picture and/or a logo and/or a bar code engraved in the ball surface. As a result, a concealed mirror image is drawn by rolling the ball on a paper sheet forming a line representing for example a signature.

STATE OF THE ART

In many cases it is necessary to validate important documents such as contracts, payment orders and other instruments relating to property and finance matters by subscribing the person's name thereon. Nevertheless, it is a commonly known that in many cases signatures have been falsified and documents misused. Generally, it is relatively easy to falsify a signature while the verification of its authenticity may be a time consuming and high technology requiring work and may cause difficulties even to professionals.

The previous ballpoint pens have been invented to solve this problem, i.e. to ensure that the signature is authentic. Such pens are provided with engraved signs on their writing bodies but their bodies are mostly of cylindrical shape. As a result, their surface rolls on the paper only in one direction and thus only one-direction line is produced. The authenticity of a signature subscribed with usual writing means can be ensured by underlining thereof or by leading a line across the signature. Such solution is described for example in the patent application PCT/IN3/00162. The pens invented so far were characterized by an unreliable performance. The capillary phenomena occurred on the areas with engraved signs when covered by a writing liquid film. The signs were clogged and thus the function of the ballpoint pen for such a purpose was substantially eliminated.

SUMMARY OF THE INVENTION

The above mentioned difficulties are overcome by a pen ball according to this invention. The ball mounted on a pen tip has a diameter D in the range from $700\times10^{-6}$ to $2500\times10^{-6}$ m and is provided with at least one sign engraved in its surface in the form of an alphanumeric character and/or picture and/or a logo. The main principal features of this invention are such that the sign is formed by a system of engraved individual cells located on the ball cap. The circumference of the base OD of the ball cap ranges from about $10\times10^{-6}$ m to 0.5 $\pi$D and the diameter of the circle circumscribing the plan view shape of the cell ranges from $10\times10^{-6}$ m to 1/7 D, while the depth of the cell is in the range of about $5\times10^{-6}$ m to 2×Dc of the circle. The advantage of the ball, comprising at least one sign exhibiting the geometry as described, is that when rolling on the paper sheet the ball draws in the line such an imprint of the sign, that it may be easily legible when properly zoomed, and its quality is affected to the minimum by the properties of the writing medium or by its changes in the course of the time, and such a ball is also most suitable for a mass production. In manufacturing, the advantage is that the sign or a portion thereof is made on the ball surface, or the ball cap respectively, by engraving on a clamped ball in one production step without the necessity to change the position of the ball.

Advantageously, the ball surface may include at least one area without cells that is located in the plane of the ball surface. It is also advantageous if such an area constitutes a closed continuous band running along the whole circumference of the ball. The continuous band ensures a reliable rotation of the ball in the seat of the holding portion of the pen tip with a minimum friction gradient.

The ball surface may advantageously include two continuous bands, one of which being situated in the meridian direction and the other perpendicular to it. Like in the first embodiment, the bands ensure reliable rotation of the ball in the holding portion of the pen tip.

To restrict the friction of the ball during its rotation in the tip seat it is advantageous that the band is at least $10\times10^{-6}$ m in width.

In order to ensure that at least the portion of the ball surface which is in contact with the paper sheet is permanently covered by a most uniform film of the writing medium, the ball is provided with a ring adjoining its surface to wipe the superfluous writing medium off the ball surface, and to enable that this area of the ball surface receives only such an amount of the writing medium that would warrant that a line is produced in such a quality, that when properly zoomed the sign would be really visible.

It is advantageous that the ring for wiping off the superfluous writing medium is provided on its area adjoining the ball surface with grooves skewed to the plane passing through the front face of the ring. The quantity of the writing medium supplied to the surface of the ball, when rolling on the paper sheet and forming a line, may be controlled by the angle of the grooves, their number and a cross section.

One of the advantageous forms of the grooves embodiment is making the grooves in a shape of a portion of a spiral or inclining the grooves at an angle of 45°. The quantity of the writing medium supplied to the surface of the ball rolling on the paper sheet and forming a line may be controlled by the number and a cross section of the grooves.

The grooves ensuring the supply of a predetermined quantity of the writing medium to the ball surface that is in contact with the paper sheet, on which the ball is rolling, may be advantageously made in the seat of the pen tip, in which the ball is held.

It is advantageous if at least one of the cells be provided at its bottom with an identification micro-code identifying the ball or pen manufacturer, or bearing other information. To the same effect, the identification code may be located in a concave recess made at the cell bottom.

The pen ball is advantageously shaped in such a manner that the thickness of the sign line is greater than $10\times10^{-6}$ m. Therefore, the thickness of the line corresponds to the minimum cell diameter.

The advantage of this technical solution is that, in accordance with the technology used for making cells, the cell may have a cross section in the form of a circle, rectangular, polygon, lozenge, or rhomboid.

For the manufacturing reasons, it is advantageous if the ball is made from silicone nitride $Si_3N_4$. When engraving the signs in the ball surface made from this material, for example by means of a laser beam, no fins are formed along the cell periphery projecting above the spherical surface, and thus the additional machining thereof is avoided.

The ball can be made from a material of the group comprising glass, ceramics, plastics, ruby, sapphire, and steel.

BRIEF DESCRIPTION OF THE DRAWINGS

This invention is in more details explained by the accompanying drawings.

FIG. 12 is a representation of a ball surface with a group of letters engraved according to this invention; while

EXAMPLES OF PREFERRED EMBODIMENTS

Figure 1:
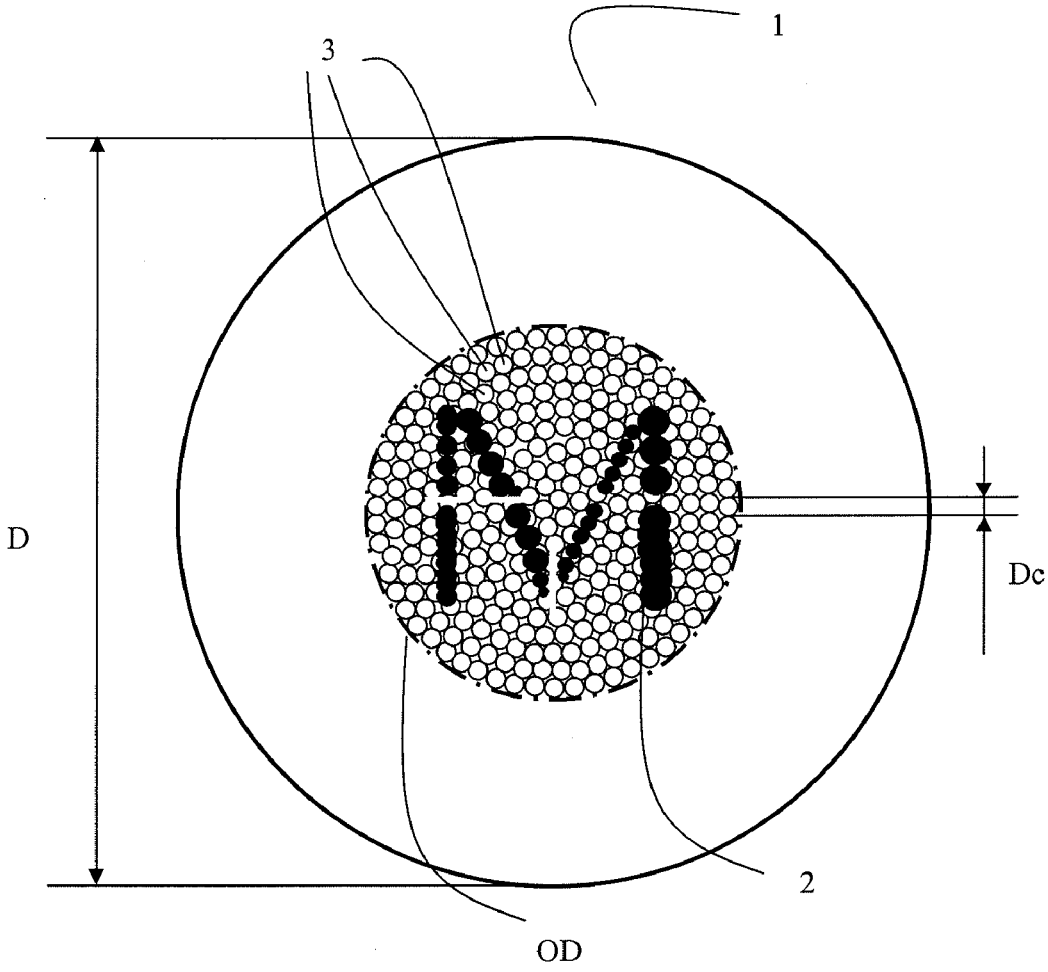
FIG. 1 is a schematic view of the pen ball according to the invention. A portion of the ball surface in a shape of a ball cap, on which white cells represent a set of cells that could be theoretically engraved in the ball cap surface, is shown, while the position of the ball with respect to the laser beam source remains unchanged. The black cells represent a system of cells actually engraved in the ball cap surface, which form a sign in the form of a letter M.

As shown in FIG. 1 the surface of a ball 1 having diameter in the range of D $700\times10^{-6}$ to $2500\times10^{-6}$ m comprises a defined area in the form of a ball cap, the basis of which has a circumference OD equal to approximately minimum dimension of the cell 3, i.e. to a diameter Dc ranging from $10\times10^{-6}$ to 0.5 πD.

Figure 12:
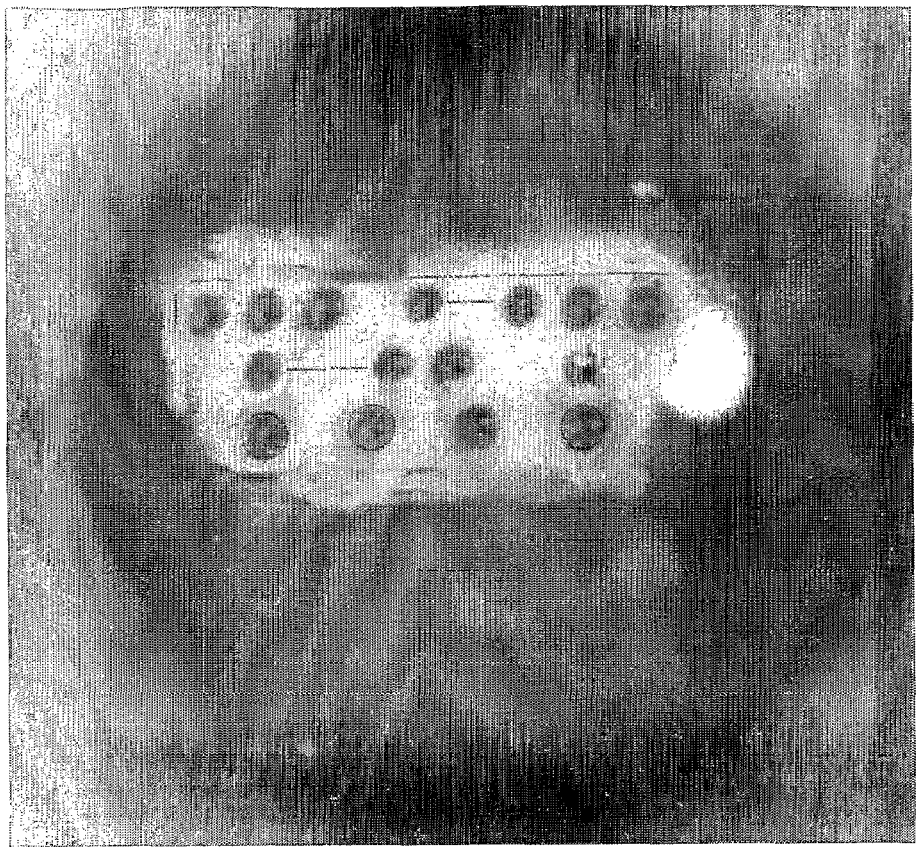
Figure 14:
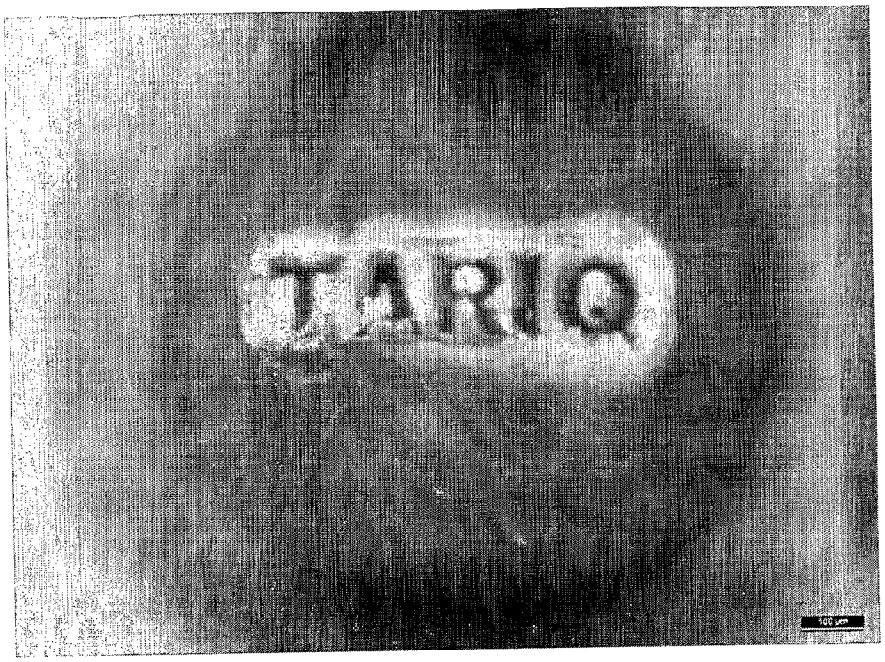
FIG. 14 is another representation of an enlarged ball surface having an engraved group of other letters.

If the sign 2 that may be in the form of an alphanumeric sign and/or a picture and/or a logo and/or a bar code in a complete and/or partial form is engraved in the surface of a ball cap, then after rolling of a ball 1 on the paper sheet and producing a line, the sign 2 contained in the line is legible when properly enlarged as shown in FIGS. 12 and 14.

The formation of the sign 2 on the surface portion of the defined ball cap, when the sign 2 is to be engraved in the ball 1 surface, is advantageous as well.

If the sign 2 or its part or a plurality of signs 2 shall be formed on the ball 1 surface, then in the event that such signs 2 are formed of cells 3 located on the said ball cap, it is possible to form such signs 2 or cells 3, which together constitute the sign 2, by means of a laser beam without the necessity to change the position of the ball 1 in relation to the laser source when forming the sign 2 or a group of signs 2.

In the cause of engraving, the ball 1 is held, for example, on a support by suction effect of subatmospheric pressure generated on the support abutting area.

The use of said construction elements of the ball 1 is therefore also advantageous with respect to a mass production.

In the embodiment of FIG. 1 the cells 3 are depicted as white small circles that could be theoretically engraved in the surface of the ball cap in one production step when the ball 1 is held in the support to be engraved, whereby upon rolling the ball 1 on the paper sheet the formation of its imprints in the paper after completion of the rolling of the respective portion of the ball 1 surface of on the paper surface would be guaranteed.

Figure 2:
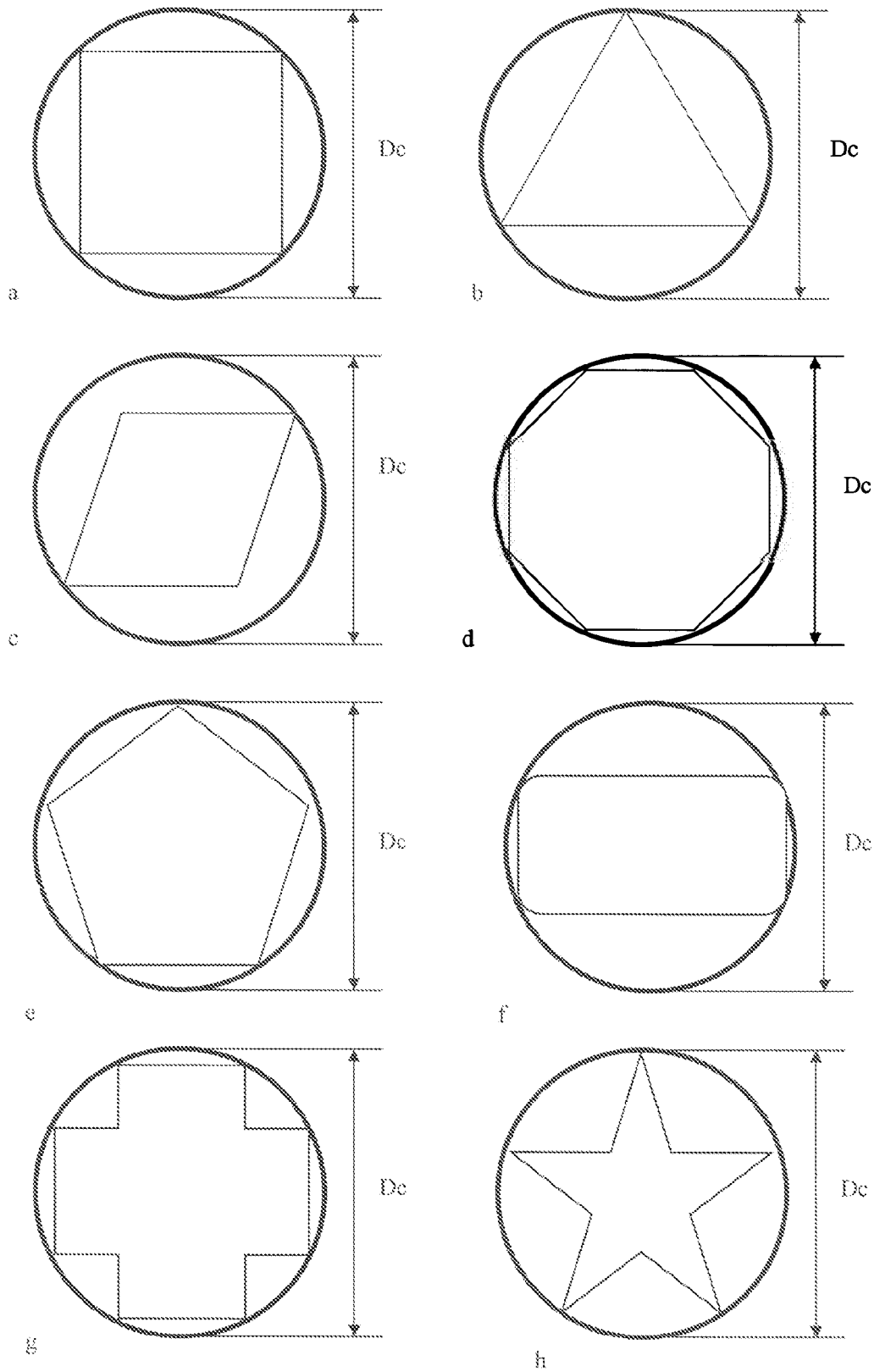
FIG. 2, parts a) to h), shows plan view shapes of cells of which signs may be formed.
Figure 5:
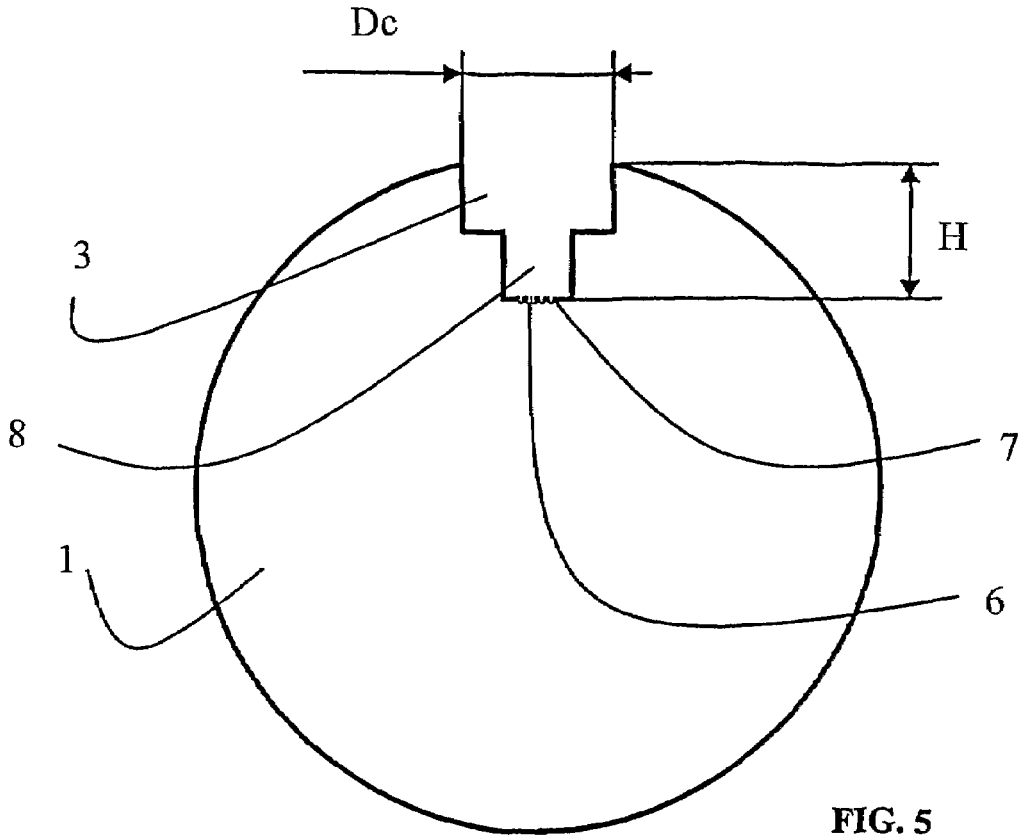
FIG. 5 shows a cross-section of a ball with a cell engraved therein in which a cavity recess for the location of a micro-code has been made. (In this example the code is 007.)

The cell 3 is to be understood as a micro-pit made in the surface of the ball 1 by engraving. The black dots in FIG. 1 represent cells 3 actually engraved in the surface of the ball cap, and they constitute a system of cells 3 arranged as shown in this example to form a sign 2 in the form of a letter "M". In FIG. 2 parts a) to h) demonstrate the possible plan view shapes of cells 3, or cross-sections of cells 3 respectively, perpendicular to the depth H, as shown in FIG. 5.

The shapes of the cells 3 are circumscribed by circles with the diameter Dc representing the characteristic size of the cell 3 that has to be retained in relation to the diameter of the ball 1, in order to achieve the aim of this invention.

It is apparent that the cells 3 are located in such positions that they are all together able to exhibit the required picture or sign 2 in the form of a letter.

Figure 3:
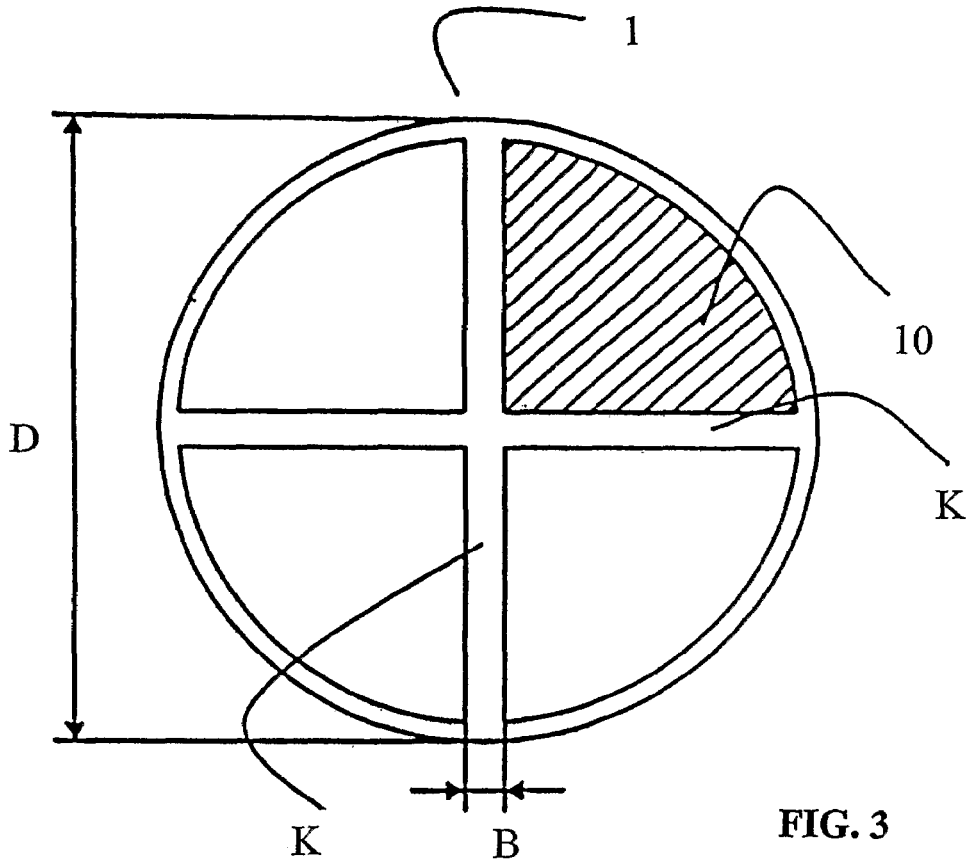
FIG. 3 is a view of a ball surface provided with continuous bands, which surround the whole periphery of the ball and on which cells are not formed.
Figure 4:
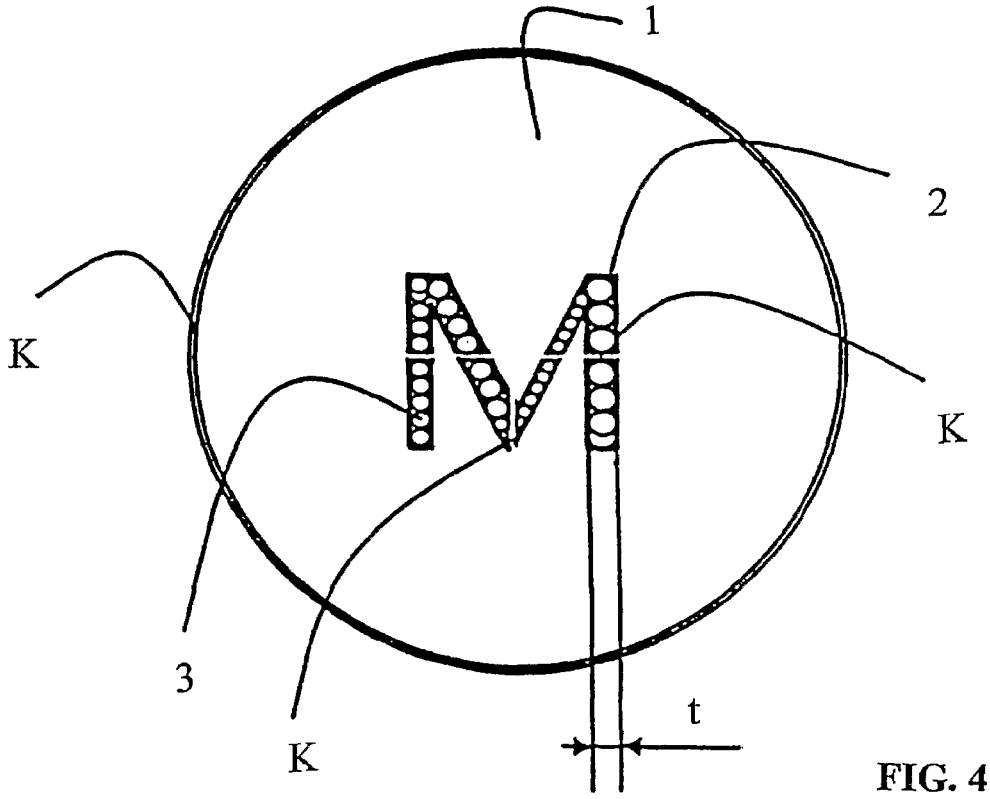
FIG. 4 is a view of a pen ball surface provided with an engraved sign in the form of a letter M formed from individual cells and broken bands without engravings.
Figure 9:
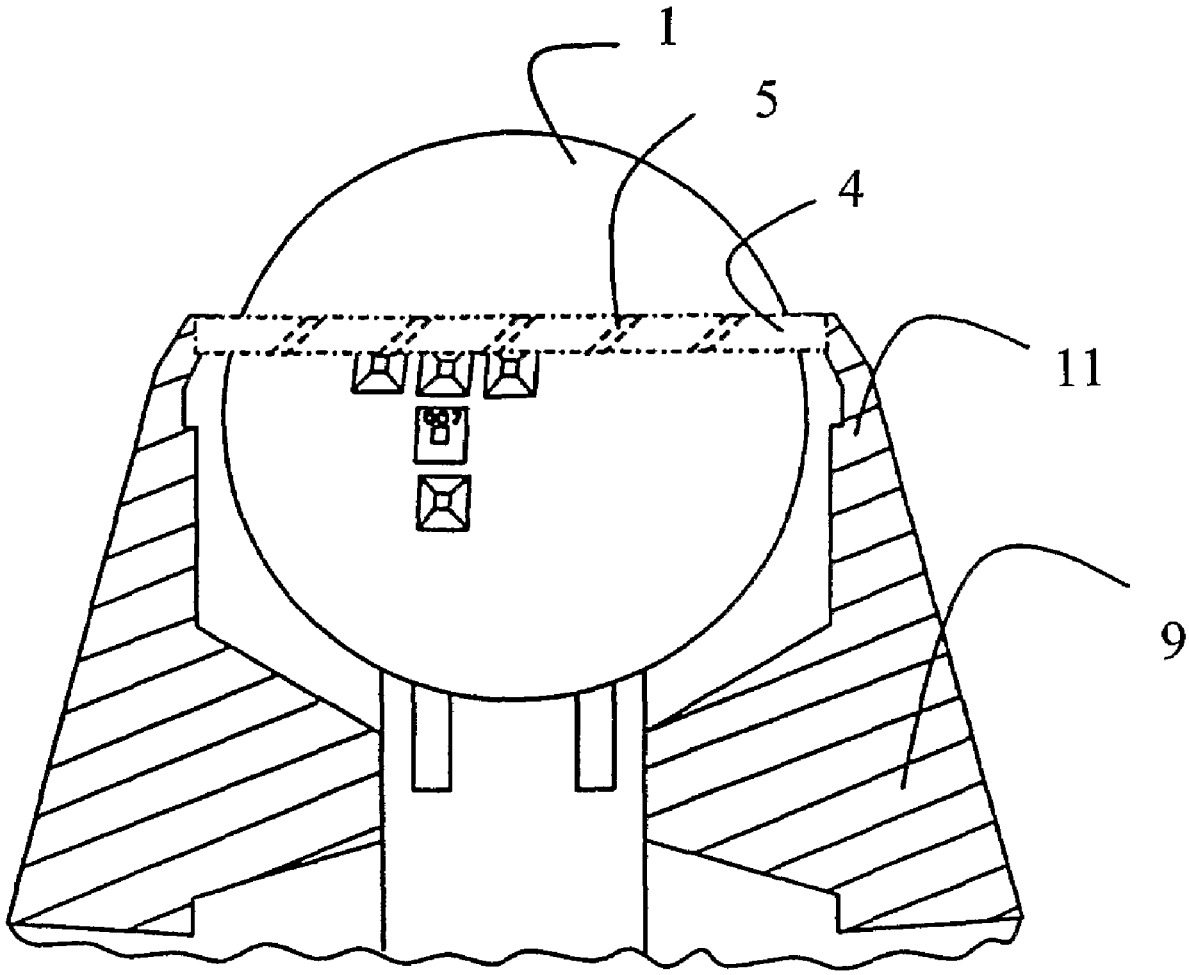
FIG. 9 is a schematic view of a ball with a ring put on the pen tip.

The cross-section configuration is determined by the technology used for the formation of the cell 3. A condition to be observed is that the diameter Dc of the circle circumscribing the shape of the cell 3 is at least in the range from $10\times10^{-6}$ m to 1/7 D and the depth of the cell 3 from $5\times10^{-6}$ m to 2×Dc of the circle. The minimum thickness t of the line of the sign 2 is equal to the minimum diameter of the cell 3, i.e. to about $10\times10^{-6}$ m. FIG. 3 is a schematic view of the surface of the ball 1 provided with bands K which are perpendicular to each other and which are to ensure good sliding of the ball 1 on the surface of the seat 11 of the tip 9, in which the ball 1 is mounted, or on other surfaces in contact with the ball 1 as shown in FIG. 9. FIG. 4 shows a complete embodiment of one of the engraved signs that illustrates the track of bands K. In FIG. 3 a surface portion 10 of the ball 1 is marked by hatching. The hatching represents schematically the ball cap area on which a continuous field of cells 3 may be produced. As appears from FIG. 3 the surface portion 10 of the ball 1 is separated by bands K from other surfaces. Likely, the cells 3 could be formed on surface portions 10 that are shown as circle quadrants in this embodiment.

Figure 6:
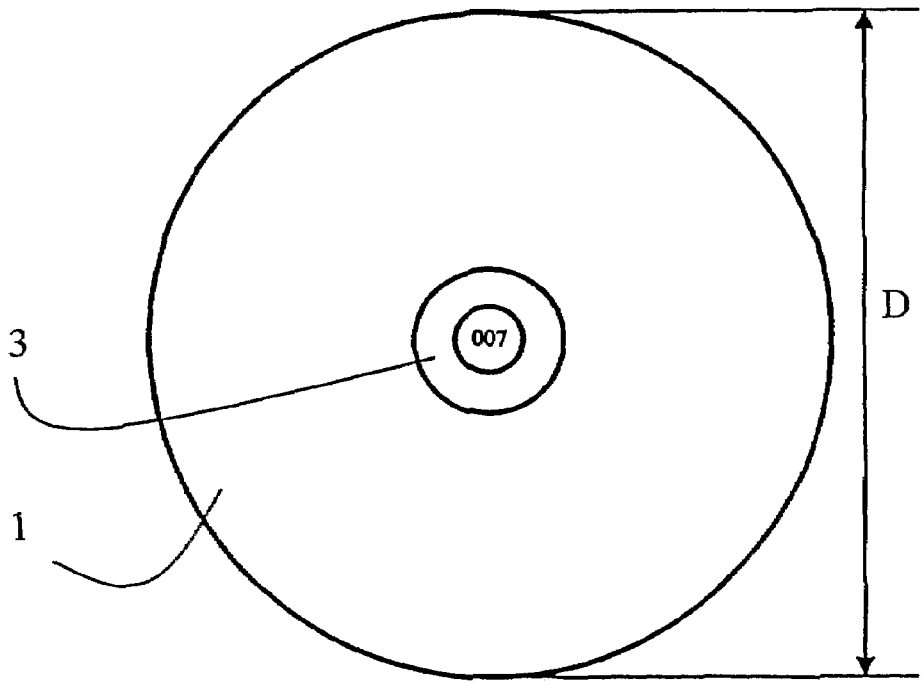
FIG. 6 is a plan view of the cell shown in FIG. 5.
Figure 7:
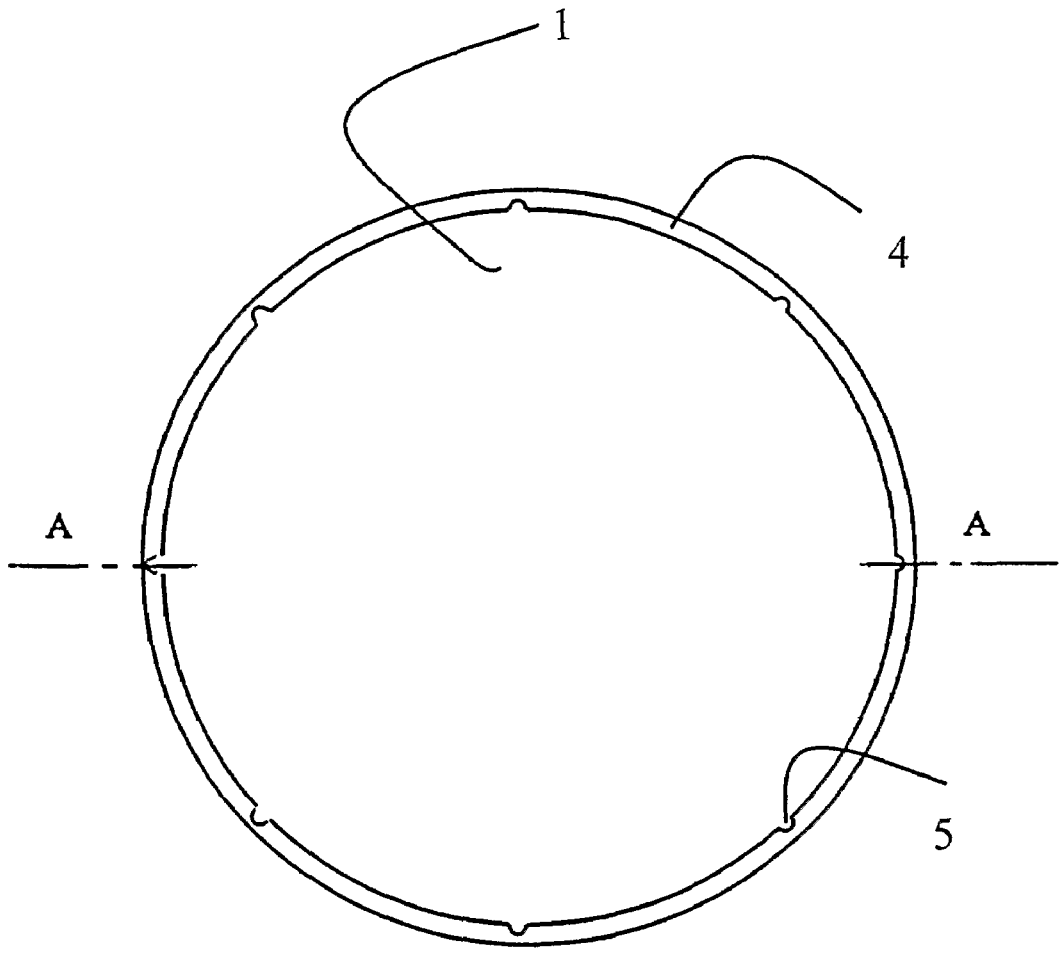
FIG. 7 is a plan view of a ball surface with an adjoining ring provided with grooves for wiping the superfluous writing medium off the ball surface.
Figure 8:
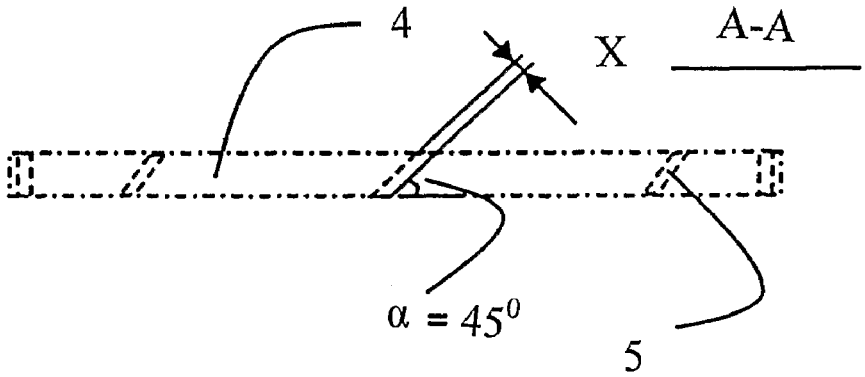
FIG. 8 is a cross-section of the ring from FIG. 7 and it shows a schematic view of the grooves in the ring and their inclination.
Figure 10:
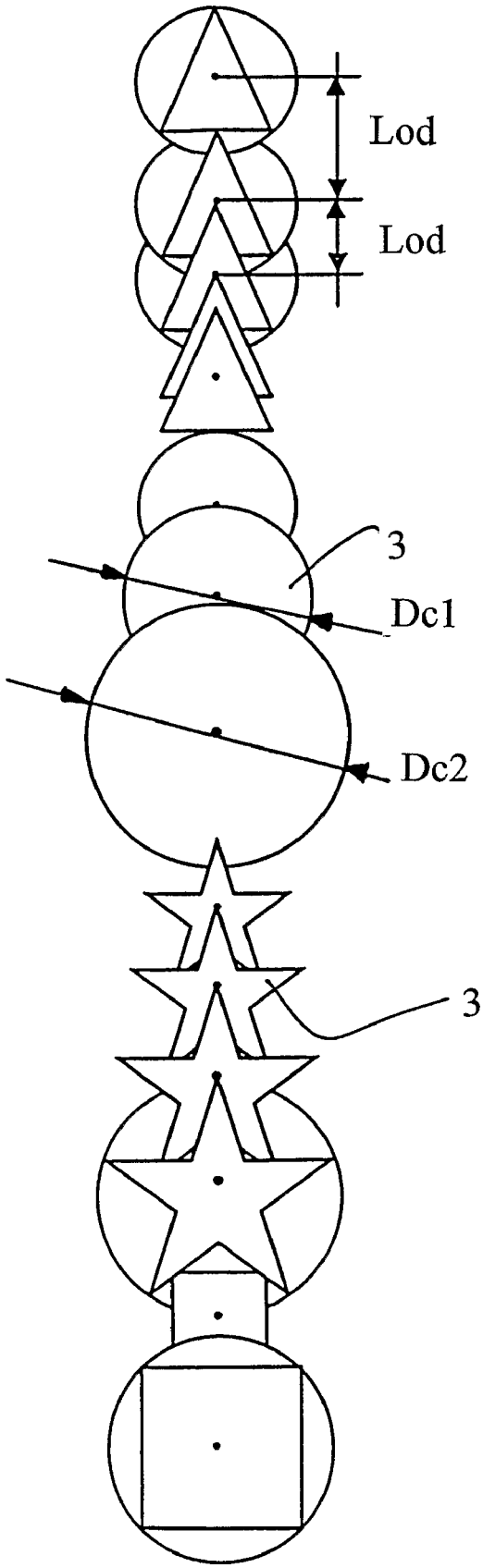
FIG. 10 is a view of a system of engraved cells of various plan views, shapes and sizes, which in total form a sign that is then contained in a line produced and that identifies the person who owns the ballpoint pen according to the invention.

Nevertheless, to ensure low friction of the ball 1 in the walls of the seat 11 of the pen tip and thus to ensure its reliable rotation and consequently the rolling on the paper sheet during the writing process the surface portions 10 are separated by the said bands K. The width B of the band K should be at least $10\times10^{-6}$ m, i.e. it should be equal to the minimum diameter Dc of the cell 3. The bands K are disposed in the plane of the ball 1. To ensure a good function of the ball 1, i.e. the formation of legible signs in the line made by a ballpoint pen provided with the ball 1, it is advantageous if a ring 4 provided with grooves 5 is put on the surface of the ball 1. The schematic plan view of the ring 4 is shown in FIG. 7. FIG. 8 shows a cross-section A-A of the ring 4 taken along the line A-A shown in FIG. 7. The grooves 5 having the width x are inclined at an oblique angle to the plane passing through the front face of the ring 4. The grooves 5 can be straight and inclined at an angle of 45° or may be arranged to form a portion of a spiral. The number of grooves 5 on the periphery of the ring 4, their inclination, shape and size depend on the writing medium used. The grooves 5 may be formed in the seat 11 of the tip 9 of the ballpoint pen. FIG. 9 is a schematic view of the ball 1 mounted in the seat 11 of the pen tip with the ring 4 put thereon. FIG. 5 shows a cross-section of one embodiment of the cell 3 formed in the surface of the ball 1. The cell 3 is provided with a cavity recess 8 at its bottom 6 and the lower portion of the bottom bears a micro-code 7 identifying the manufacturer of the ball 1 or the pen, or bearing any other information. The plan view of such a cell 3 is shown in FIG. 6. By a combination of the shapes of the cells 3 and their size, various surface forms, or signs 2 respectively, may be produced as shown in FIG. 10. The centers of the circles circumscribed around the shapes of cells 3 are spaced from each other by the distance Lod within the range of $$1\times10^{-6}\,m<\mathrm{Lod}<\tfrac{1}{2}\pi D-B-\tfrac{1}{2}Dc1-\tfrac{1}{2}Dc2$$

where D=diameter of the ball 1, B=width of the band K, and Dc1 and Dc2=diameters of the adjacent cells 3.

Figure 11A:
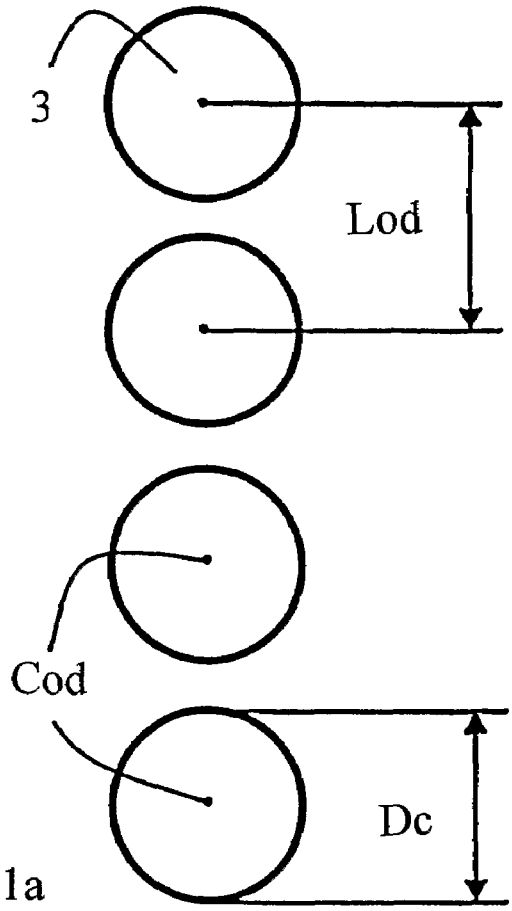
FIGS. 11*a*) and 11*b*) represent schematic views of cells with different spaces between them.
Figure 11B:
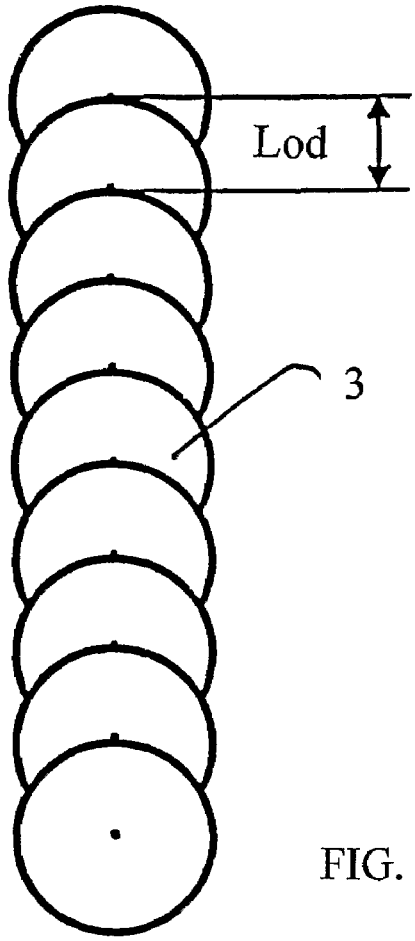

FIG. 11 shows examples of the configurations of cells 3 with various distances Lod between their centers indicated as Cod. FIG. 12 shows their image made by rolling the ball 1 on a paper sheet.

Figure 13:
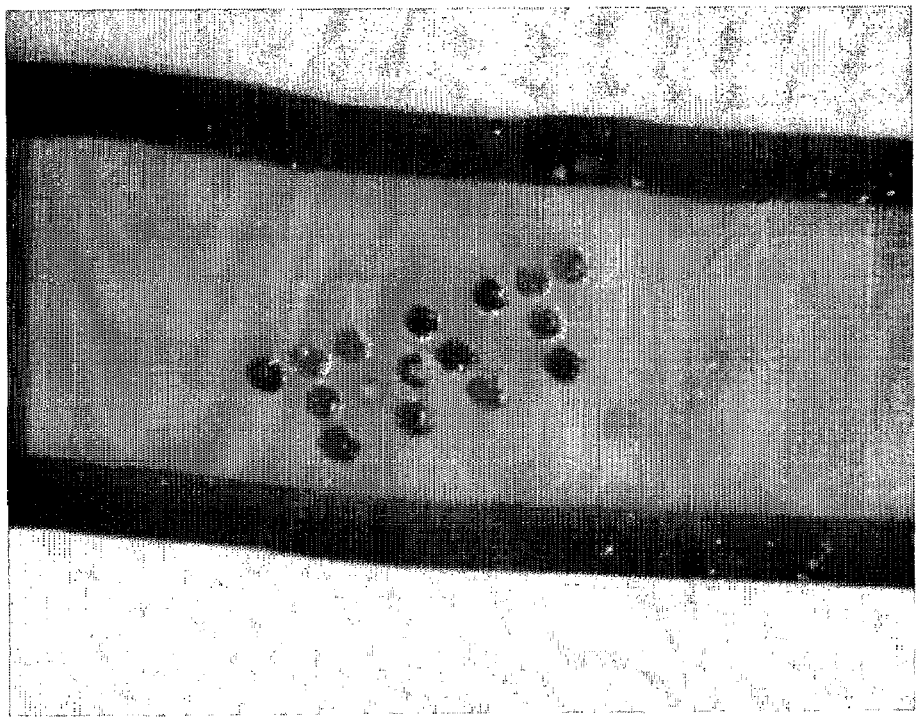
FIG. 13 is a representation of a line produced by a ball of FIG. 12 at about 100 times magnification and with an imprint of a group of the said letters.
Figure 15:
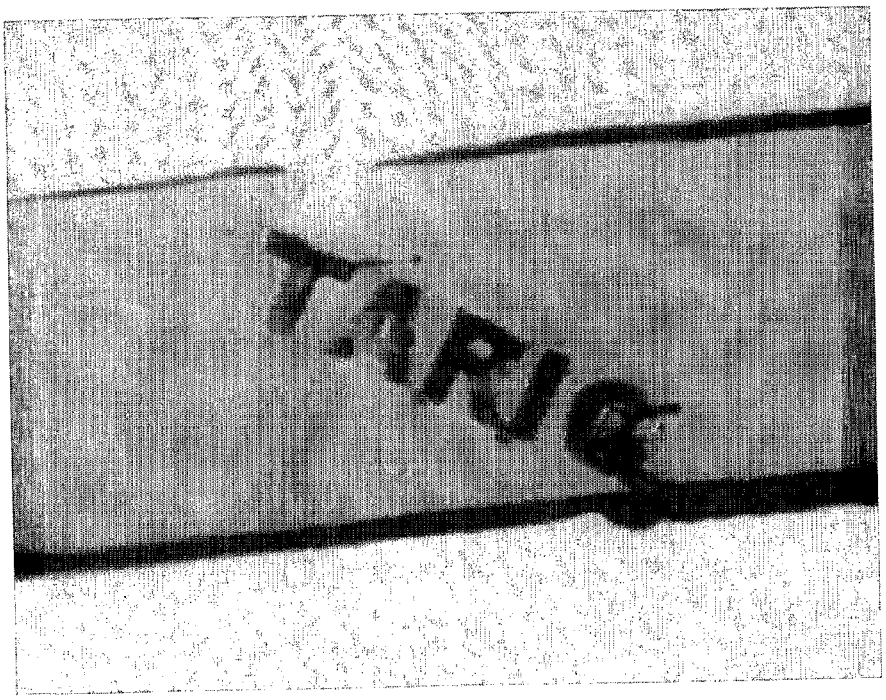
FIG. 15 is a representation of line at 170 times magnification containing an imprint of the group of said letters.

After rolling the ball 1 on a paper sheet, even when moving on the paper sheet in disordered and incidental directions, a line is formed in which after appropriate magnification, for example 100 times, the signs 2 may be found that constitute a portion of the code assigned to a concrete individual. The presence of the code is the evidence that the signature of such an individual is authentic and genuine. Examples of the signs 2 engraved in the surface of the ball 1 are shown in FIGS. 12 and 14. In both examples a ball diameter D of 1.5 mm has been used. FIG. 13 shows 100 times magnification of a portion of the line comprising an "imprint" of the sign 2 engraved, by the method according to this utility model application, in the ball 1 of FIG. 12. FIG. 14 shows another example of the ball 1 and FIG. 15 a view of a portion of the line and the image of the sign 2 formed by the ball 1, at 170 times magnification.

INDUSTRIAL APPLICABILITY

A ball of a pen tip can be used for the formation of a line exhibiting any curvature, comprising a code in the form of a sign 2 or a system of signs 2 selected by the owner of the pen, and witnessing the authenticity of the signature of the owner. Thus the ball of the pen tip according to the present technical solution will prevent others from falsifying a signature or another document identification sign.

The invention claimed is:

1. A ball (1) of a pen tip (9) being from D $700\times10^{-6}$ to $2500\times10^{-6}$ in diameter and comprising at least one sign (2) engraved in the surface thereof, characterized in that the sign (2) is constituted by a system of engraved individual cells (3) situated on the surface of a spherical cap of the ball (1) with a base having a circumference OD in the range from $10\times10^{-6}$ m to 0.5 πD and the diameter Dc of the circle circumscribing the plan view shape of the cell (3) is in the range from $10\times10^{-6}$ m to 1/7 D, whereby the depth of the cell (3) is in the range from $10\times10^{-6}$ m to 2×Dc.

2. The ball (1) of the pen tip (9) as claimed in claim 1 characterized in that the surface of the ball (1) includes at least one area free of cells (3) situated in the plane passing through the surface of the ball (1), constituted of a continuous band (K).

3. The ball (1) of the pen tip (9) as claimed in claim 2 characterized in that the surface of the ball (1) includes two bands (K), out of which the first band is situated in the meridian direction while the second band is perpendicular to the first band.

4. The ball (1) of the pen tip (9) as claimed in claim 3 characterized in that the width (B) of the band (K) is at least $10\times10^{-6}$ m.

5. The ball (1) of the pen tip (9) as claimed in claim 4 characterized in that the surface of the ball (1) adjoins a ring (4) for wiping off the superfluous writing medium and providing that a defined amount of writing medium is supplied to the surface of the ball (1) that is in contact with a paper sheet, on which the ball (1) rolls.

6. The ball (1) of the pen tip (9) as claimed in claim 5 characterized in that the ring (4) for wiping the superfluous writing medium off the surface of the ball (1) is provided, on its surface adjoining the surface of the ball (1), with grooves (5) declined from the plane passing through the front portion of the ring (4) for supplying the necessary writing medium to the surface of the ball (1), which rolls on the paper sheet during writing.

7. The ball (1) of the pen tip (9) of as claimed in claim 6 characterized in that the grooves (5) are in the form of a portion of a spiral.

8. The ball (1) of the pen tip (9) as claimed in claim 6 characterized in that the grooves (5) are inclined at an angle of 45°.

9. The ball (1) of the pen tip (9) of claim 1 characterized in that the ball (1) is mounted in a seat (11) of the pen tip (9), which is provided with grooves (5), adjoining the surface of the ball (1), for supplying a defined amount of writing medium to the surface of the ball (1), which surface is in contact with the paper sheet, on which the ball rolls.

10. The ball (1) of the pen tip (9) of claim 1 characterized in that at least one of the cells (3) is provided with a micro-code (7) at its bottom (6).

11. The ball (1) of the pen tip (9) of claim 1 characterized in that at least one of the cells (3) is provided at its bottom (6) with at least one cavity (8) for locating the micro-code (7).

12. The ball (1) of the pen tip (9) of claim 1 characterized in that the thickness (t) of a line of the sign (2) exceeds $10\times10^{-6}$ m.

13. The ball (1) of the pen tip (9) of claim 1 characterized in that the cross section of the cell (3) perpendicular to its depth takes the form of a circle, rectangular, polygon, lozenge, or rhomboid.

14. The ball (1) of the pen tip (9) of claim 1 characterized in that the sign (2) is an alphanumeric character and/or a picture and/or a logo and/or a bar code.

15. The ball (1) of the pen tip (9) of claim 1 characterized in that the ball (1) is made of silicone nitride $Si_3N_4$.

16. The ball (1) of the pen tip (9) of claim 1 characterized in that the ball (1) is made of a material elected from the group including glass, ceramics, plastics, ruby, sapphire, and steel.

* * * * *